United States Patent [19]

Inoue

[11] Patent Number: 4,730,465

[45] Date of Patent: Mar. 15, 1988

[54] ACCUMULATOR FOR A REFRIGERATION SYSTEM

[75] Inventor: Atsuo Inoue, Isesaki, Japan

[73] Assignee: Sanden Corporation, Japan

[21] Appl. No.: 938,999

[22] Filed: Dec. 8, 1986

[30] Foreign Application Priority Data

Dec. 7, 1985 [JP] Japan ..... 60-187932[U]

[51] Int. Cl.[4] ..... F25B 43/00

[52] U.S. Cl. ..... 62/503; 62/125

[58] Field of Search ..... 62/503, 125

[56] References Cited

U.S. PATENT DOCUMENTS

| | | | |
|---|---|---|---|
| 3,420,071 | 1/1969 | Bottum | 62/503 |
| 3,438,218 | 4/1969 | O'Neil | 62/503 |
| 3,938,353 | 2/1976 | Wrenn, Jr. et al. | 62/503 |
| 4,474,034 | 10/1984 | Avery, Jr. | 62/503 |

FOREIGN PATENT DOCUMENTS

| | | |
|---|---|---|
| 040351 | 3/1979 | Japan . |
| 602749 | 4/1978 | U.S.S.R. . |
| 615338 | 7/1978 | U.S.S.R. . |

*Primary Examiner*—Ronald C. Capossela

*Attorney, Agent, or Firm*—Banner, Birch, McKie & Beckett

[57] ABSTRACT

An accumulator for an automotive refrigeration system is disclosed. The accumulator includes a housing having a cover, an inlet port for introducing refrigerant, an outlet port, and a U-shaped tube having one end connected to the outlet port and an other end opening to the upper portion of the housing of the accumulator at a predetermined level. A conduit is vertically disposed in the housing of the accumulator and has lower end opening into the housing at a level lower than the other end of the U-shaped tube. The upper end of the conduit communicates with the outlet port through a fluid passage. A sight glass is disposed on the fluid passage to view the refrigerant. On charging the system, when refrigerant is in view, the proper volume of refrigerant is enclosed in the refrigeration system.

6 Claims, 4 Drawing Figures

ACCUMULATOR FOR A REFRIGERATION SYSTEM

TECHNICAL FIELD

This invention relates to an accumulator for a refrigeration system. More particularly, this invention relates to an accumulator for an automotive refrigeration system which permits detection of the proper volume of refrigerant in the system.

BACKGROUND OF THE INVENTION

In a refrigeration system including a compressor, a condenser, a fixed throttle valve, and an evaporator having an outlet port connected to an accumulator, the proper volume of refrigerant in the refrigeration system must be maintained. If the proper volume of refrigerant is not enclosed in the refrigeration system problems occur. If too much refrigerant is enclosed within the system, refrigerant in the liquid phase can be forced from the accumulator into the compressor because the capacity of the accumulator is too small, and the compressor can suffer damage by compressing liquid refrigerant. Also, the compression capacity may decrease. On the other hand, if too little refrigerant is in the refrigeration system, there may be no refrigerant in the accumulator. The temperature of the refrigerant at an inlet port of the compressor therefore may increase, and the refrigeration capacity of the evaporator will decrease.

If the accumulator is used in an automotive air conditioner, the volume of the accumulator depends on the size of the engine compartment and on operational factors which cause the amount of refrigerant in the accumulator to vary. Thus, the accumulator should be small enough to fit in the engine compartment, but be sized to accommodate refrigerant throughout the range of rotational speeds of the compressor, throughout the range of thermal loads on the evaporator, and throughout the range of thermal loads on the condensor. If properly sized, the accumulator will be filled with refrigerant when the rotational speed of the compressor is the lowest (i.e, at engine idle), when the thermal load on the evaporator is lowest (e.g., when air entering the evaporator has a temperature of 20° C. to 25° C. and relative humidity of about 50%), and when the thermal load on the condenser is highest (e.g., air temperature at the condenser inlet is 30° C. to 35° C.). When the rotational speed of the compressor and the thermal load on the evaporator are the highest (e.g., air temperature at the inlet is 30° C. to 35° C. and relative humidity is about 50%), there will be virtually no refrigerant in the accumulator.

In a conventional method for measuring the volume of refrigerant, the surface temperature of the outlet port of the evaporator is initially measured to determine the proper refrigerant amount (if the temperature is sufficiently low, the refrigerant volume is proper). However, this method has a very low degree of precision.

Another method for detecting low refrigerant levels involves measuring the clutch cycling time (the duration the compressor clutch is on and off). The clutch cycling time is shortened when the refrigerant volume is low. However, since the clutch cycling time can be shortened by other factors as well, it is an imprecise method for detecting the lack of refrigerant.

One apparatus for detecting the proper amount of refrigerant is disclosed in Japanese Utility Model Application Publication No. 57-33343. In this application, as illustrated in FIG. 1, accumulator 6 comprises housing 61 having an open end covered by end plate 62. Inlet port 7 is disposed on the upper portion of housing 61 and communicates between the inside of housing 61 and an evaporator (not shown). Outlet tube 8 communicates between the inside of housing 61 and a compressor (not shown), and a conduit 63 vertically extends inside housing 61. End plate 62 has depression 64 which is covered by sight glass 65 to form a small space. One end of conduit 63 is open to depression 64 which communicates with outlet tube 8 through passageway 66. The other end of conduit 63 extends to the lower portion of housing 61 to draw gaseous refrigerant and entrained lubricating oil to outlet tube 8 though depression 64 and passageway 66. Accordingly, if the liquid refrigerant passes through depression 64 its existence can be confirmed through sight glass 65. However, liquid refrigerant may flow past sight glass 65 even when refrigerant volume is improper. Moreover, because conduit 63 and passageway 66 return some lubricating oil to housing 61, liquid can be detected whether or not refrigerant exists in the lower portion of housing 61. In addition, when the volume of accumulator 6 is minimized as required, it is difficult to properly detect refrigerant therein by this method.

Another known accumulator 6, as shown in FIG. 2, includes inlet port 7 and U-shaped tube 9 integrally formed with outlet port 8. U-shaped tube 9 is provided with lower opening 91 for returning lubricating oil to the accumulator and upper opening 92 for equalizing pressure. Immediately after the compressor stops, a pressure difference is produced between the compressor and accumulator 6 causing liquid refrigerant to flow into U-shaped tube 9 through hole 91 and into the inside of the compressor. Since U-shaped tube 9 is provided with hole 92 to equalize the pressure difference, the compressor does not does not compress liquid refrigerant when the compressor is restarted. However, in the above accumulator, it is impossible to detect the refrigerant volume in the refrigeration system.

SUMMARY OF THE INVENTION

It is a primary object of this invention to provide an accumulator for an automotive refrigeration system which properly detects the volume of refrigerant in the system.

It is another object of this invention to provide an accumulator for an automotive refrigeration system which prevents liquid refrigerant from flowing out of the accumulator.

It is still another object of this invention to provide an accumulator for an automotive refrigeration system which prevent superheating the liquid refrigerant at an outlet port of an evaporator.

It is still another object of this invention to provide a compact accumulator for an automotive refrigeration system.

An accumulator for an automotive refrigeration system according to the present invention includes a housing having a cover, an inlet port for introducing a two phase mixture of refrigerant (and lubricating oil) from an evaporator, an outlet port for withdrawing gaseous refrigerant from the accumulator, and a U-shaped tube. The U-shaped tube is connected at one end to the outlet port and is positioned at a predetermined level at its other end. A conduit vertically extends within the interior of the accumulator having its lower end opening below the other end of the U-shaped tube. The upper end of the conduit is connected to the outlet port through a fluid passage formed at a level above the other end of the U-shaped tube. A sight glass is disposed on the fluid passage to view liquid refrigerant. The U-shaped tube may be provided with a hole for returning lubricating oil to the accumulator at its lowest portion.

Various additional advantages and features of novelty which characterize the invention are further pointed out in the claims that follow. However, for a better understanding of the invention and its advantages, reference should be made to the accompanying drawings and descriptive matter which illustrate and describe the preferred embodiment of the invention.

DETAILED DESCRIPTION OF THE INVENTION

Figure 1:
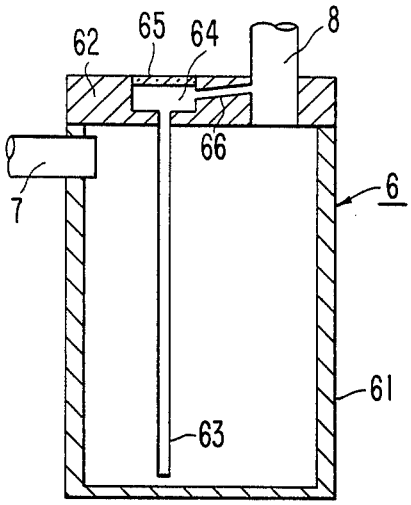
FIG. 1 PRIOR ART
FIG. 1 is a cross-sectional view of a known accumulator, referred to above.
Figure 2:
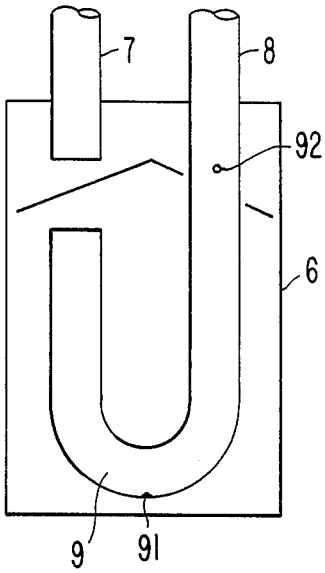
FIG. 2 PRIOR ART
FIG. 2 is a cross-sectional view of another known accumulator, referred to above.
Figure 3:
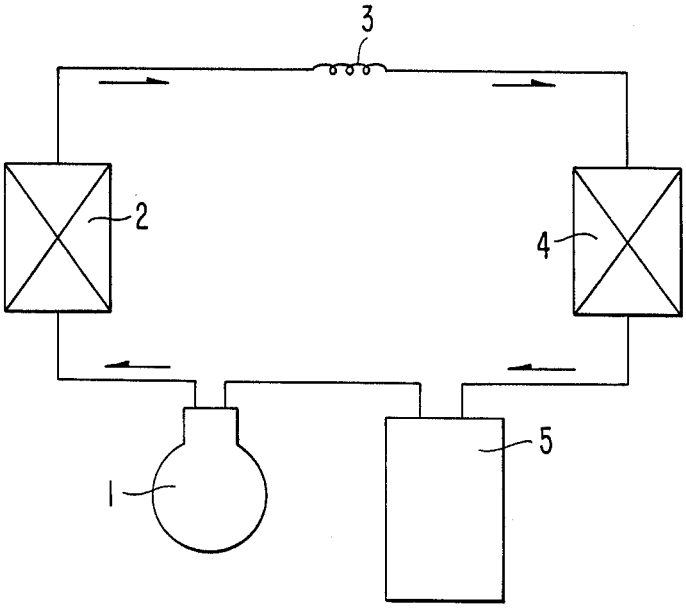
FIG. 3 is a schematic diagram of an automotive refrigeration system including an accumulator according to the present invention.

Referring to FIG. 3, a refrigeration circuit including an accumulator according to the present invention is shown. The refrigeration circuit generally comprises compressor 1, condenser 2, fixed throttle valve 3, evaporator 4, and accumulator 5. These basic components are coupled in series to form a conventional refrigeration circuit. The arrows indicate the direction of flow of refrigerant. Gaseous refrigerant is compressed in compressor 1 and supplied to condenser 2 where it is cooled by rejecting heat to the ambient air and condensed to liquid refrigerant. The liquid refrigerant is delivered to throttle valve 3 where it expands. The refrigerant emerges from throttle valve 3 as a two phase mixture of liquid and gas, primarily liquid. As the two phase mixture of refrigerant flows through evaporator 4, which acts as a heat exchanger, heat is transferred to the refrigerant from incoming air (such as interior air in the vehicle passenger compartment), and the refrigerant vaporizes and assumes its gaseous state. This gaseous refrigerant flows into accumulator 5.

Figure 4:
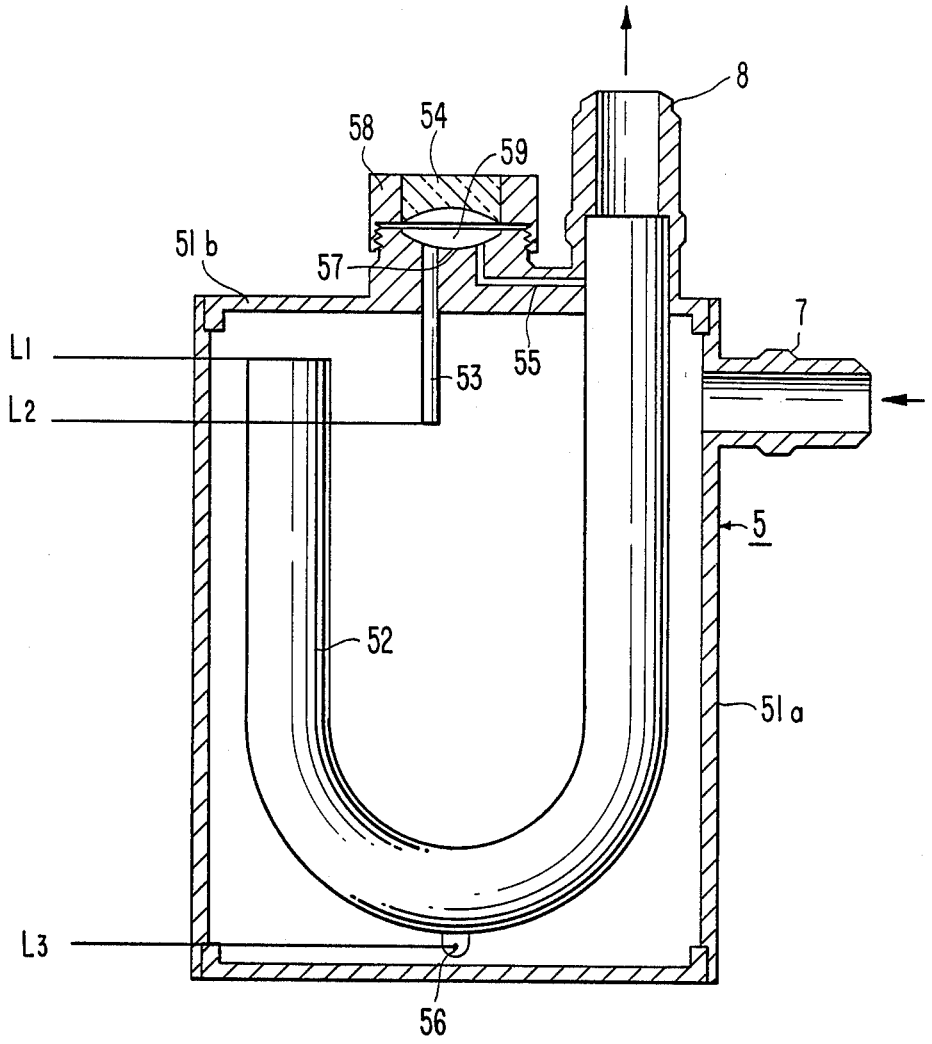
FIG. 4 is a cross-sectional view of an accumulator according to the present invention.

Referring to FIG. 4, the construction of accumulator 5 in accordance with the present invention is shown. Accumulator 5 comprises cylindrical housing 51*a* having an upper opening covered by cover plate 51*b*, fluid inlet port 7 formed on the outer peripheral surface of housing 51*a*, fluid outlet port 8 formed on cover plate 51*b*, and U-shaped tube 52 disposed within the interior of housing 51*a*. U-shaped tube 52 is supported within housing 51*a* by connection to the inner end opening of outlet port 8 to form a fluid outlet passage. Cover plate 51*b* is provided with concave depression 57 at its upper end surface. Depression 57 is covered by cap 58 to form small gap 59. Cap 58 has a sight glass 54 to permit viewing small gap 59. Small gap 59 communicates with the interior of housing 51*a* through conduit 53, and communicates with outlet port of 8 through U-shaped tube 52 and connecting way or bore 55 which is formed in cover plate 51*b*. Therefore, conduit 53, small gap 59, and connecting way 55 define a fluid passage between the interior of housing 51*a* and the outlet portion of U-shaped tube 52.

The free end of U-shaped tube 52 is open to the upper portion of housing 51*a* at level L1 as shown in FIG. 4. Conduit 53 vertically extends within the interior of housing 51*a* having its lower end at level L2 which is slightly lower than level L1. Also, oil return hole 56, formed on the lower portion of U-shaped tube 52 at level L3, is placed near the bottom portion of housing 51*a* and is below L2.

The difference between level L1 and level L2 is set so when the two phase mixture of refrigerant is drawn into the interior of housing 51*a* through inlet tube 7 and the refrigerant exceeds level L2, liquid refrigerant is drawn into conduit 53 and flows through small gap 59 and connecting way 55 to outlet port 8 by the pressure difference between the opening of conduit 53 in housing 51*a* and outlet port 8. The flow of the two phase refrigerant mixture may be visually inspected and its existence confirmed through sight glass 54, thereby indicating that the refrigerant level in accumulator 6 exceeds level L2. The highest level of refrigerant in accumulator 6 should be between L1 and L2.

Accordingly, if accumulator 5 is properly sized to accommodate the range of rotational speeds of compressor 1 and the range of thermal loads of evaporator 4 and condenser 2, and the system is charged with the correct volume of refrigerant, the level of refrigerant in accumulator 5 should very from a low point just above L3 to a high point between L1 and L2. The highest level will be achieved with compressor 1 at idle, the thermal load on evaporator 4 at a minimum, and the thermal load on condensor 2 at a maximum. Conversely, the lowest level of refrigerant in accumulator 5 wil be achieved when the rotational speed of compressor 1 and the thermal load on evaporator 4 are at their maximums.

The method of properly enclosing refrigerant (i.e., charging the system) is as follows. The refrigeration system is maintained with the rotational speed of compressor 1 at its lowest level (i.e, at idling of the engine), the thermal load on evaporator 4 at its lowest level, and the thermal load on condenser 2 at its highest level. Then the refrigerant is enclosed in the refrigeration system. While enclosing the refrigerant, the amount is confirmed through sight glass 54. If the flow of refrigerant is visually confirmed, enclosing should cease, because, as described above, this indicates that the refrigerant level has surpassed level L2. Therefore, the proper amount of refrigerant is enclosed within the refrigeration system.

Furthermore, since level L1 of the opening of U-shaped tube 52 is set slightly higher than level L2 of the oening of conduit 53, any excess liquid refrigerant in accumulator 5 is prevented from flowing out of accumulator 5 into compressor 1 by flowing into and residing in U-shaped tube 52. This compensates for the situation where the refrigeration system operates under conditions causing the thermal load on evaporator 4 to be slightly lower than the lowest expected load and the thermal load of condenser 2 to be slightly higher than the highest expected load, and the actual volume of refrigerant enclosed in the refrigeration system is slightly greater than the required volume (occasioned, for example, by slight overcharging). Also, the fluid passage which comprises connecting way 55, concave depression 57, small gap 59, and conduit 53 functions as a pressure equalizer. This prevents liquid refrigerant from being drawn out of accumulator 5.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

What is claimed is:

1. In an accumulator for a refrigeration system having a housing including a cover, an inlet for introducing two phase refrigerant, an outlet port for withdrawing gaseous refrigerant, a U-shaped tube disposed within said housing and having one end connected to said outlet port and the other end open and positioned at a predetermined level within said housing, the improvement comprising:

a conduit vertically extending downwardly within the interior of said housing having a lower end opening below said other end of said U-shaped tube and an upper end connected to said outlet port through a fluid passage above said predetermined level of said other end of said U-shaped tube, wherein said predetermined level of said other end of said U-shaped tube and the level of said lower end opening of said conduit are selected so that when the accumulator is fully charged the refrigerant level in the accumulator lies between said predetermined level of said other end of said U-shaped tube and said level of said lower end opening of said conduit; and a sight glass disposed on said fluid passage to view refrigerant.

2. The accumulator as claimed in claim 1 wherein the upper end of said conduit extends through said cover, said fluid passage is formed in said cover and said sight glass is disposed on said cover and overlies the upper end of said conduit.

3. The accumulator as claimed in claim 2, wherein said fluid passage comprises a depression formed on an upper surface of said cover, and a bore formed in said cover to communicate between said depression and said outlet port, and wherein said conduit opens into said depression, and said sight glass covers said depression to form a small gap.

4. The accumulator as claimed in claim 3, wherein a hole is formed in the lowest portion of said U-shaped tube to further communicate the interior of said tube with the interior of said housing.

5. The accumulator as claimed in claim 2, wherein a hole is formed in the lowest portion of said U-shaped tube to further communicate the interior of said tube with the interior of said housing.

6. The accumulator as claimed in claim 1, wherein a hole is formed in the lowest portion of said U-shaped tube to further communicate the interior of said tube with the interior of said housing.

* * * * *